US008920253B2

(12) United States Patent
Horst et al.

(10) Patent No.: US 8,920,253 B2
(45) Date of Patent: Dec. 30, 2014

(54) BABY SWING

(75) Inventors: Andrew J. Horst, West Lawn, PA (US); Nathanael Saint, Morgantown, PA (US)

(73) Assignee: Wonderland Nurserygoods Company Limited, Kwai Chung, N.T. (HK)

( * ) Notice: Subject to any disclaimer, the term of this patent is extended or adjusted under 35 U.S.C. 154(b) by 170 days.

(21) Appl. No.: 13/346,739

(22) Filed: Jan. 10, 2012

(65) Prior Publication Data

US 2012/0178544 A1 Jul. 12, 2012

Related U.S. Application Data

(60) Provisional application No. 61/460,943, filed on Jan. 10, 2011.

(51) Int. Cl.
*A63G 9/00* (2006.01)
*A47D 13/10* (2006.01)

(52) U.S. Cl.
CPC ..... *A47D 13/105* (2013.01)
USPC ..... 472/118

(58) Field of Classification Search
USPC ..... 472/118
See application file for complete search history.

(56) References Cited

U.S. PATENT DOCUMENTS

| | | | | |
|---|---|---|---|---|
| 5,562,548 | A | 10/1996 | Pinch | |
| 6,908,397 | B2 | 6/2005 | Armbruster | |
| 7,559,606 | B2 * | 7/2009 | Hei et al. | 297/256.12 |
| 2008/0020854 | A1 * | 1/2008 | Tuckey et al. | 472/118 |

* cited by examiner

*Primary Examiner* — Michael Dennis
(74) *Attorney, Agent, or Firm* — Winston Hsu; Scott Margo

(57) ABSTRACT

A baby swing includes a frame, a supporting device and a seat. The supporting device is pivotally connected to the frame. The supporting device has a pivot post and a plurality of first engaging members formed on a periphery of the pivot post. The seat has a mounting structure pivotally mounted on the pivot post and a second engaging member disposed in the mounting structure and capable of moving between an engaging position and a releasing position. When the second engaging member is located at the engaging position, the second engaging member engages one of the first engaging members so that the seat is retained relative to the supporting device. When the second engaging member is located at the releasing position, the second engaging member disengages from the first engaging member so that the seat is allowed to rotate relative to the supporting device.

15 Claims, 8 Drawing Sheets

BABY SWING

CROSS REFERENCE TO RELATED APPLICATIONS

This application claims the benefit of U.S. Provisional Application No. 61/460,943, which was filed on Jan. 10, 2011, and is incorporated herein by reference.

BACKGROUND OF THE INVENTION

1. Field of the Invention

The invention relates to a baby swing and, more particularly, to a baby swing with multiple swing seat positions giving a caregiver several swing motions to choose from and the baby swing offers good accessibility.

2. Description of the Prior Art

Caregivers regularly rely on a baby swing to help with the care of their infants. Baby swings are used to help provide a comfortable, safe and entertaining environment for the child.

Baby swings are basically made up of a seat to securely hold and position the baby and a frame to support the seat and allow it to swing in a front to back or side to side motion. In the prior art, there is a common design of a baby swing that swings front to back and there is another common design of a baby swing that swings both front to back and side to side. Many caregivers prefer the option of both a front to back and side to side swing motion because it allows them to customize the ride to their child's preference. The swing, which only offer front to back swinging motion, offers very good accessibility which is preferred by consumers but does not offer side to side swinging motion. The swing which offers both types of motion but it has the swivel mechanism directly above the child's head. This design, which can be referred to U.S. Pat. No. 6,908,397, restricts the accessibility to the child by the caregiver, especially when placing the child in or taking the child out of the baby swing.

SUMMARY OF THE INVENTION

An objective of the invention is to provide a baby swing with multiple swing seat positions giving a caregiver several swing motions to choose from and the baby swing offers good accessibility.

Another objective of the invention is to provide a baby swing with an engaging device for positioning a seat of the baby swing after rotating from a position to another position.

According to one embodiment of the invention, a baby swing comprises a frame, a supporting device and a seat. The supporting device is pivotally connected to the frame. The supporting device has a pivot post and a plurality of first engaging members formed on a periphery of the pivot post. The seat has a mounting structure pivotally mounted on the pivot post and a second engaging member disposed in the mounting structure and capable of moving between an engaging position and a releasing position. When the second engaging member is located at the engaging position, the second engaging member engages one of the first engaging members so that the seat is retained relative to the supporting device. When the second engaging member is located at the releasing position, the second engaging member disengages from the first engaging member so that the seat is allowed to rotate relative to the supporting device.

According to another embodiment of the invention, a baby swing comprises a frame, a supporting device, a seat and an engaging device. The supporting device is pivotally connected to the frame. The seat is pivotally mounted on the supporting device. The engaging device comprises a plurality of first engaging members at one of the supporting device and the seat and a second engaging member at another one of the supporting device and the seat. The seat is rotated relative to the supporting device between a first position and a second position and will be retained at the first position or the second position when the second engaging member is engaged with one of the first engaging members.

According to another embodiment of the invention, an engaging device is adapted for a baby swing. The baby swing comprises a frame, a supporting device and a seat. The supporting device is pivotally connected to the frame. The seat is pivotally mounted on the supporting device. The engaging device comprises a plurality of first engaging members at one of the supporting device and the seat and a second engaging member at another one of the supporting device and the seat. The seat is rotated relative to the supporting device between a first position and a second position and will be retained at the first position or the second position when the second engaging member is engaged with one of the first engaging members.

As mentioned in the above, since the seat is pivotally mounted on the supporting device, the seat is able to rotate relative to the supporting device while the second engaging member is located at the releasing position. On the other hand, when the second engaging member moves from the releasing position to the engaging position so as to engage one of the first engaging members, the seat is retained relative to the supporting device. Therefore, the baby swing of the invention can give the caregiver several swing motions to choose from based on the arrangement and the number of the first engaging members. These swing motions may include, but are not limited to, front to back and side to side motions. Furthermore, the open top frame provides the caregiver with unobstructed access to the child in the seat of the baby swing.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
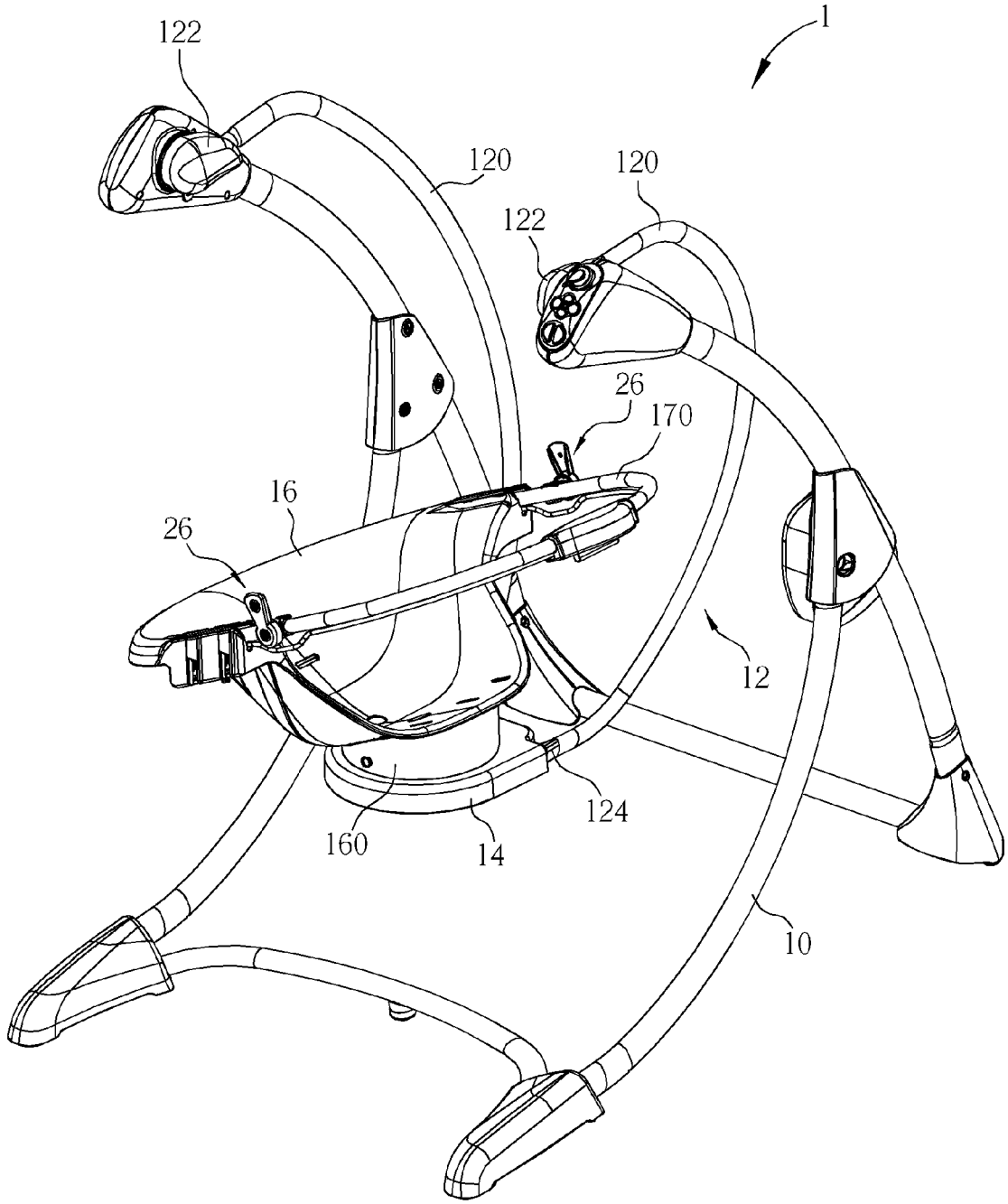
FIG. 1 is a perspective view illustrating a baby swing according to one embodiment of the invention, wherein the seat is retained at a side-facing position.
Figure 2:
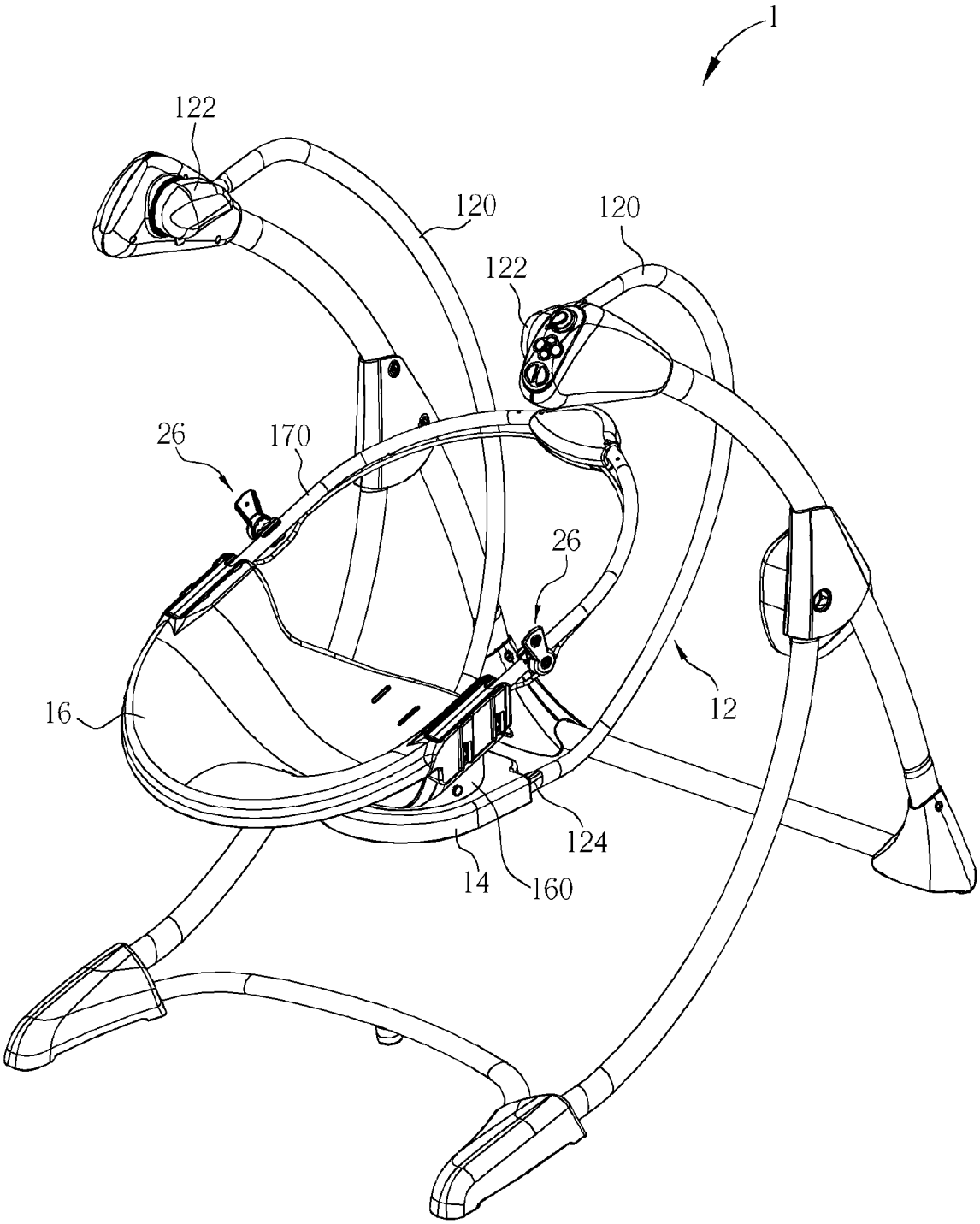
FIG. 2 is a perspective view illustrating the seat shown in FIG. 1 being rotated from the side-facing position to a forward-facing position.
Figure 3:
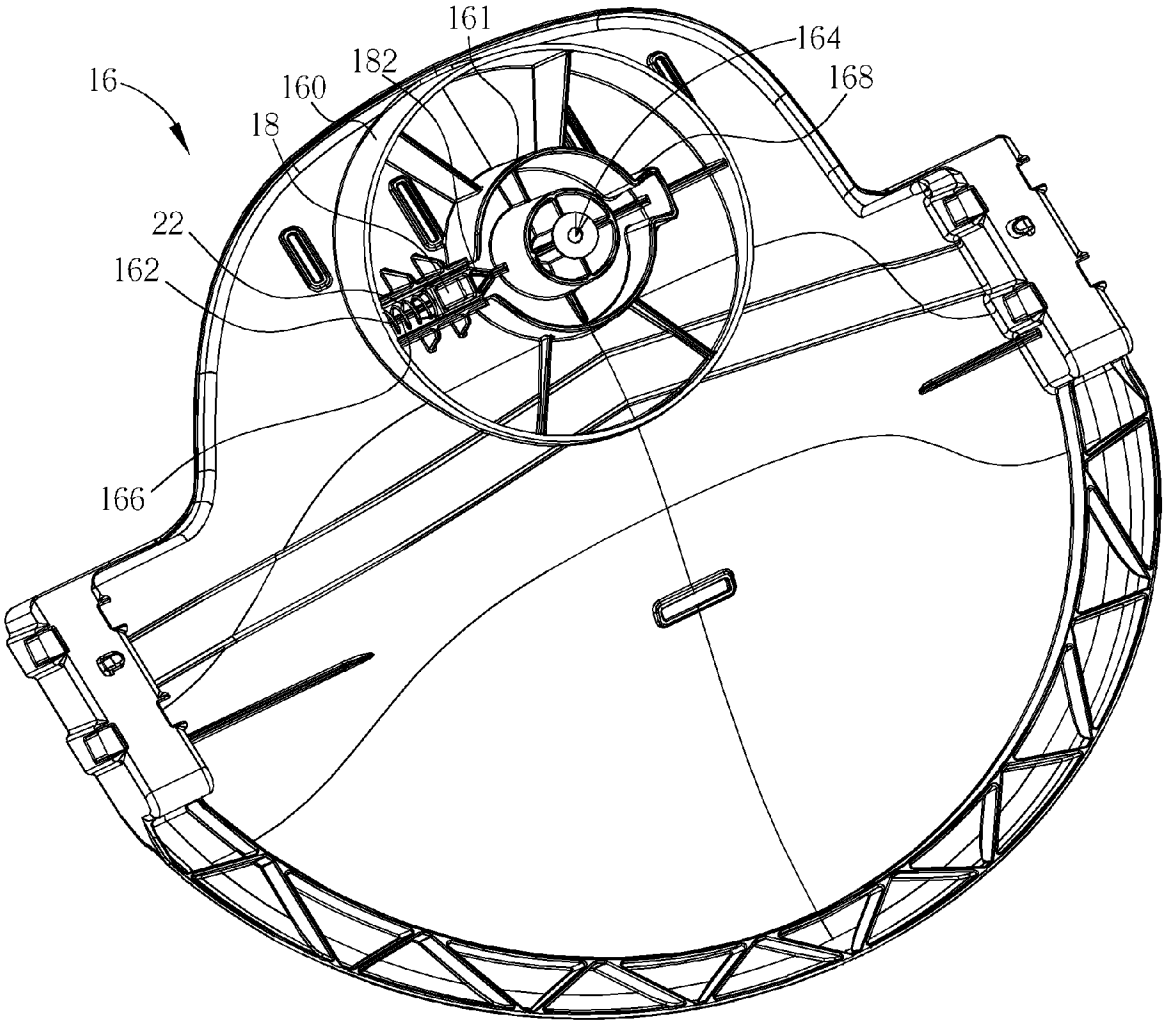
FIG. 3 is a perspective view illustrating a bottom of the seat shown in FIG. 1.
Figure 4:
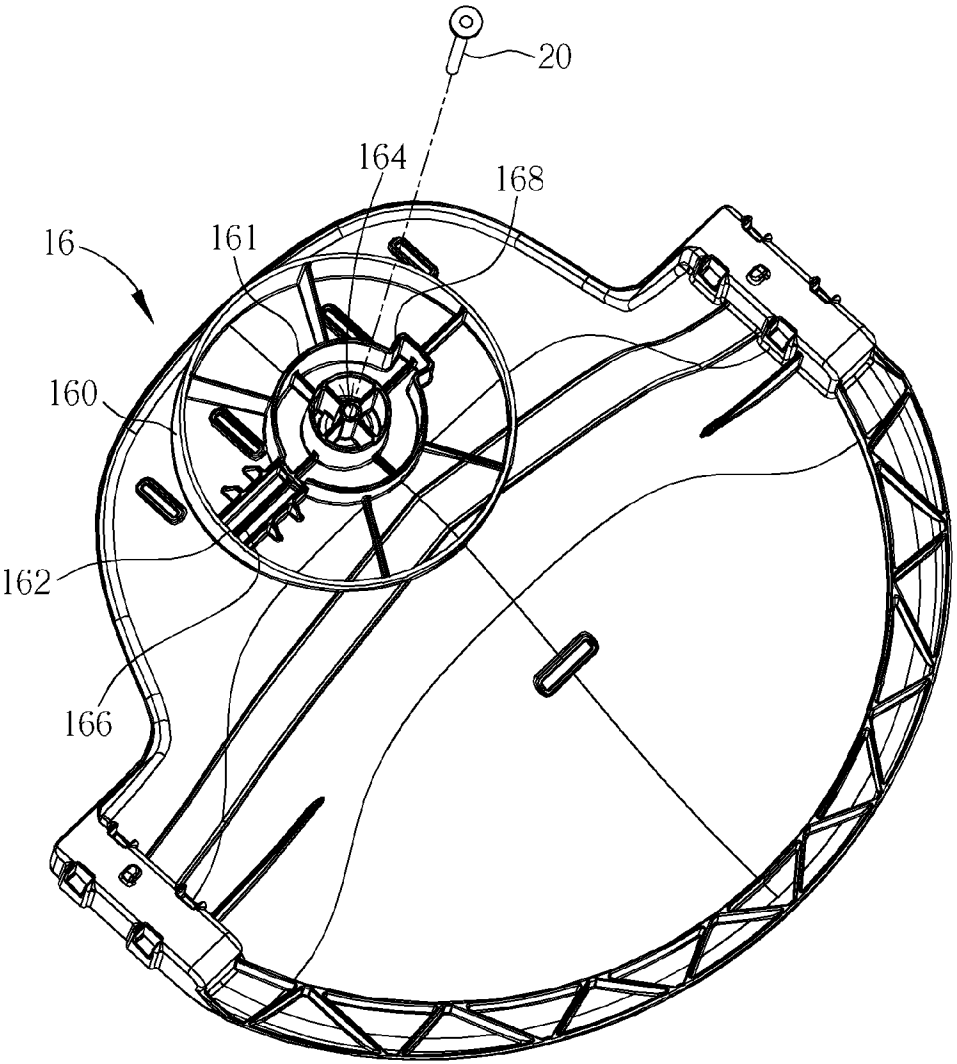
FIG. 4 is a perspective view illustrating the bottom of the seat shown in FIG. 3 without the second engaging member and the spring member.
Figure 5:
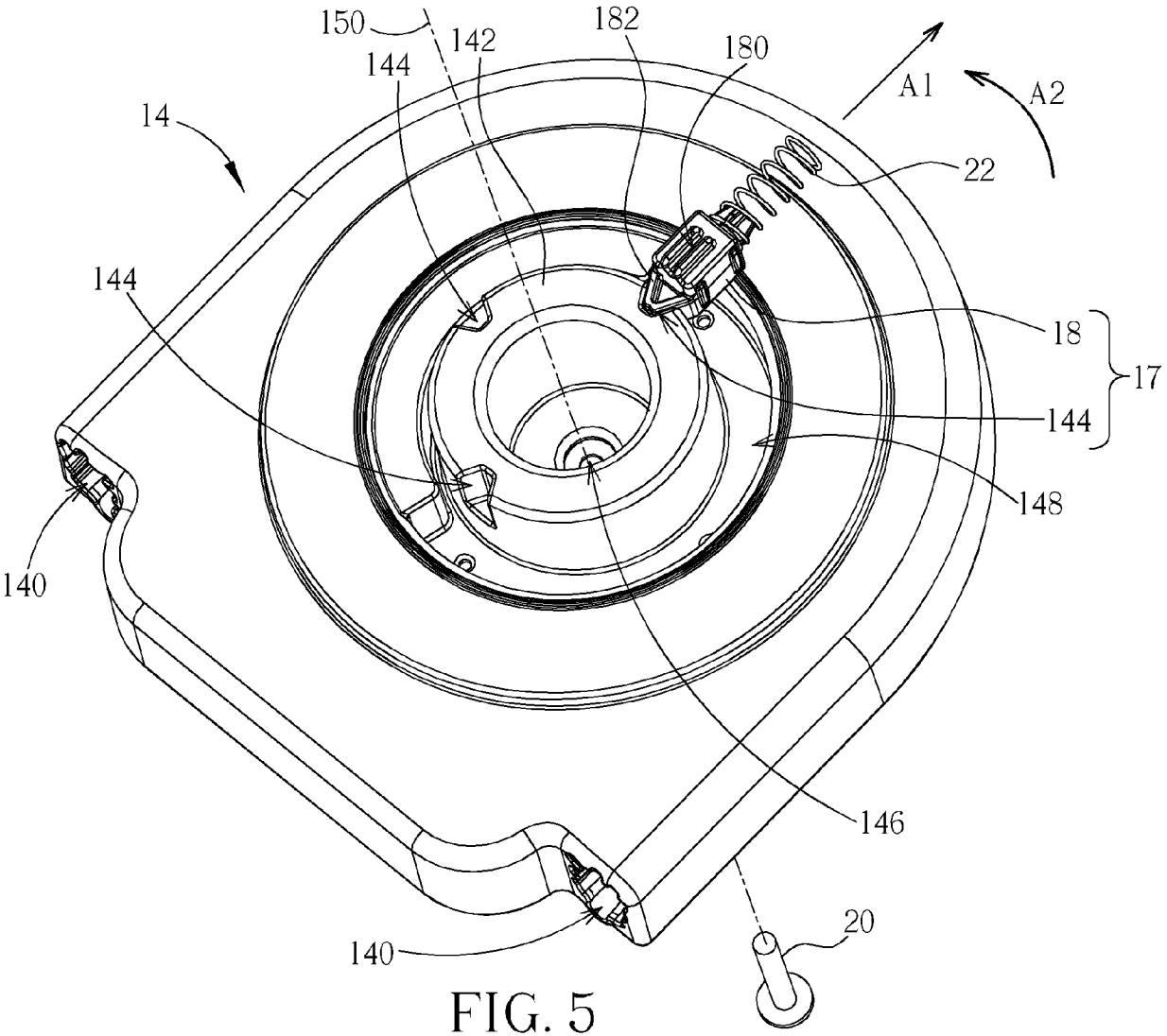
FIG. 5 is a perspective view illustrating the base, the second engaging member and the spring member, wherein the second engaging member engages one of the first engaging members.

Referring to FIGS. 1 to 5, FIG. 1 is a perspective view illustrating a baby swing 1 according to one embodiment of the invention, wherein the seat 16 is retained at a side-facing position; FIG. 2 is a perspective view illustrating the seat 16 shown in FIG. 1 being rotated from the side-facing position to a forward-facing position; FIG. 3 is a perspective view illustrating a bottom of the seat 16 shown in FIG. 1; FIG. 4 is a perspective view illustrating the bottom of the seat 16 shown in FIG. 3 without the second engaging member 18 and the spring member 22; and FIG. 5 is a perspective view illustrating the base 14, the second engaging member 18 and the spring member 22, wherein the second engaging member 18 engages one of the first engaging members 144.

The baby swing 1 comprises a frame 10, a supporting device 12, a seat 16 and an engaging device 17. The supporting device 12 is pivotally connected to the frame 10. In this embodiment, the supporting device 12 may comprise two hanger arms 120 pivotally connected to the frame 10 symmetrically through pivot ends 122 and a base 14 mounted on the two hanger arms 120, as shown in FIGS. 1 and 2. As shown in FIGS. 1, 2 and 5, the base 14 is coupled to a connecting end 124 of each hanger arm 120 that is opposite to a pivot end 122 of each hanger arm 120. Two coupling members 140 are formed on both sides of the base 14 to connect to the hanger arms 120. At this embodiment, the coupling member 140 is a hole so that the connecting end 124 of each hanger arm 120 can be inserted into the connecting member 140 correspondingly, so as to mount the base 14 on the hanger arms 120 of the supporting device 12.

As shown in FIG. 5, the base 14 has a pivot post 142 and a plurality of first engaging members 144 formed on a periphery of the pivot post 142. In this embodiment, the first engaging member 144 is formed as a recess. The pivot post 142 is cylinder and there are three first engaging members 144 formed on the periphery of the pivot post 142 in this embodiment and an angle between each two adjacent first engaging members is 90 degrees. It should be noted that the arrangement and the number of the first engaging members 144 and the angle between two adjacent first engaging members 144 may be determined based on practical applications, so they are not limited to the embodiment shown in FIG. 5.

As shown in FIGS. 3 and 4, the seat 16 has a second engaging member 18, a connecting member 20, a spring member 22, a mounting structure 160 and a pivot seat 161. The engaging device 17 includes the first engaging members 144 and the second engaging member 18. In this embodiment, the second engaging member 18 is a plunger that is biased toward to engage with one of the first engaging members 144. The pivot seat 161 is formed within the mounting structure 160 and is circular for pivotally coupling with the pivot post 142 such that the engaging device 17 is mounted between the pivot post 142 and the pivot seat 161. The second engaging member 18 is disposed in the mounting structure 160, and the spring member 22 is disposed between an inner wall 162 of the mounting structure 160 and the second engaging member 18. In this embodiment, a first pivot hole 164 is formed on the mounting structure 160 and a second pivot hole 146 is formed on the pivot post 142. The connecting member 20 shown in FIGS. 4 and 5 can pass through the first pivot hole 164 and the second pivot hole 146 so as to pivotally mount the seat 16 on the pivot post 142 of the base 14 and the seat 16 could rotate relative to the base 14 at a central axis 150. Furthermore, the second engaging member 18 may have a guiding track 180 and the mounting structure 160 may have a guiding rib 166. When the seat 16 is mounted on the base 14, the guiding rib 166 is disposed in the guiding track 180 so that the guiding track 180 can cooperate with the guiding rib 166 to guide the second engaging member 18 to move along a movement direction defined by the guiding rib 166. Moreover, the base 14 may further have a guiding groove 148 and the mounting structure 160 may have a guiding portion 168. When the seat 16 is mounted on the base 14, the guiding portion 168 is disposed in the guiding groove 148 so that the guiding groove 148 can cooperate with the guiding portion 168 to restrict a rotation range of the seat 16. In this embodiment, the guiding groove 148 is formed as a half circle, so the rotation range of the seat 16 is 180 degrees. It should be noted that the shape of the guiding groove 148 can be determined by practical applications so as to determine the rotation range of the seat 16.

In this embodiment, the second engaging member 18 is capable of moving between an engaging position and a releasing position. As shown in FIG. 5, the second engaging member 18 is located at the engaging position and engages one of the first engaging members 144 so that the seat 16 is retained relative to the base 14. At this time, the seat 16 is retained at a side-facing position, as shown in FIG. 1. Therefore, a caregiver can place a child in the seat 16 of the baby swing 1 and then the seat 16 could swing in a side to side motion. It should be noted that the open top frame 10 provides the caregiver with unobstructed access to the child in the seat 16 of the baby swing 1. If the caregiver wants to change the position of the seat 16 from the side-facing position shown in FIG. 1 to the forward-facing position shown in FIG. 2, he or she just has to rotate the seat 16 relative to the base 14.

In this embodiment, each of the first engaging members 144 has a taper shape and an engaging end 182 of the second engaging member 18, which engages the first engaging member 144, also has a taper shape. It should be noted that, in another embodiment, the first engaging member 144 may have an arc shape (e.g. half circle), and the engaging end 182 of the second engaging member 18 may also have an arc shape (e.g. half circle) correspondent to the first engaging member 144. When the seat 16 rotates relative to the base 14, the side wall of the first engaging member 144 forces the engaging end 182 of the second engaging member 18 to move toward the direction indicated by an arrow A1 shown in FIG. 5 due to the taper shapes of the first engaging member 144 and the engaging end 182 of the second engaging member 18. It should be noted that the direction indicated by the arrow A1 is perpendicular to and away from the central axis 150 of the pivot post 142. The caregiver does not have to operate any operator to move the second engaging member 18 to the releasing position. He or she only has to hold the seat 16 and rotates the seat 16 relative to the base 14 to push the second engaging member 18 toward the releasing position. When the second engaging member 18 is located at the releasing position (i.e. the second engaging member 18 disengages from the first engaging member 144), the seat 16 is allowed to rotate relative to the base 14 toward the direction indicated by an arrow A2 shown in FIG. 5 and the spring member 22 is compressed by the peripheral wall of the pivot post 142 and the spring member 22 provides an elastic force for the second engaging member 18. After the caregiver rotates the seat 16 relative to the base 14 with 90 degrees, the elastic force provided by the compressed spring member 22 pushes the second engaging member 18 to engage another first engaging member 144 and the seat 16 is retained relative to the base 14 again. Consequently, the seat 16 is retained at the forward-facing position as shown in FIG. 2 and the seat 16 could swing in a front to back motion. If the caregiver wants to change the position of the seat 16 from the forward-facing position shown in FIG. 2 to the side-facing position shown in FIG. 1, he or she just has to rotate the seat 16 relative to the base 14 in the same manner as mentioned in the above.

It should be noted that, in another embodiment, the plurality of first engaging members 144 may be formed at the seat 16 and the second engaging member 18 may be disposed at the supporting device 12. In other words, the plurality of first engaging members 144 may be formed at one of the supporting device 12 and the seat 16, the second engaging member 18 may be disposed at another one of the supporting device 12 and the seat 16, and it depends on practical applications.

Figure 6:
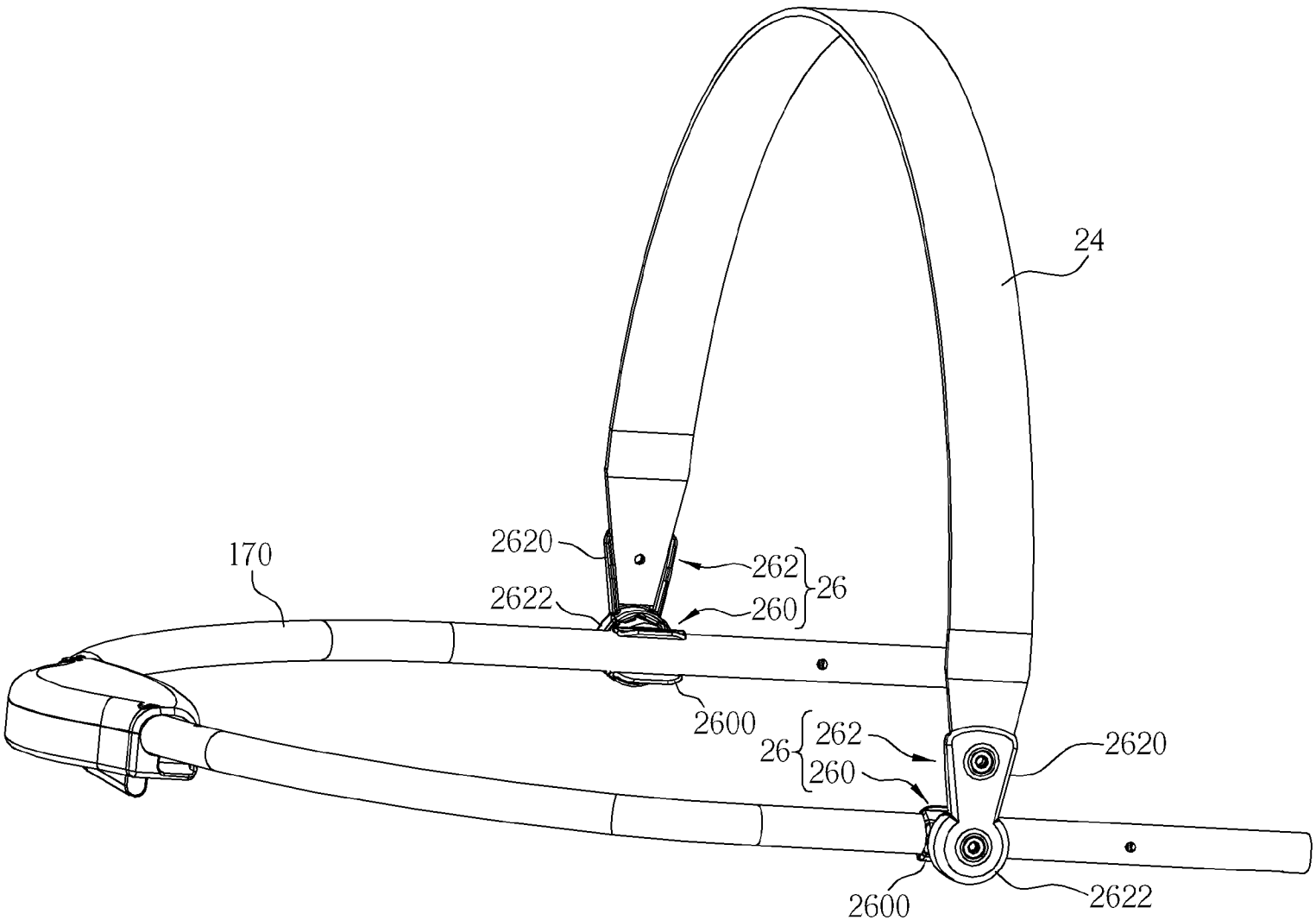
FIG. 6 is a perspective view illustrating a rotating member rotatably connected to a rear frame of the seat shown in FIGS. 1 and 2 through two join mechanisms.
Figure 7:
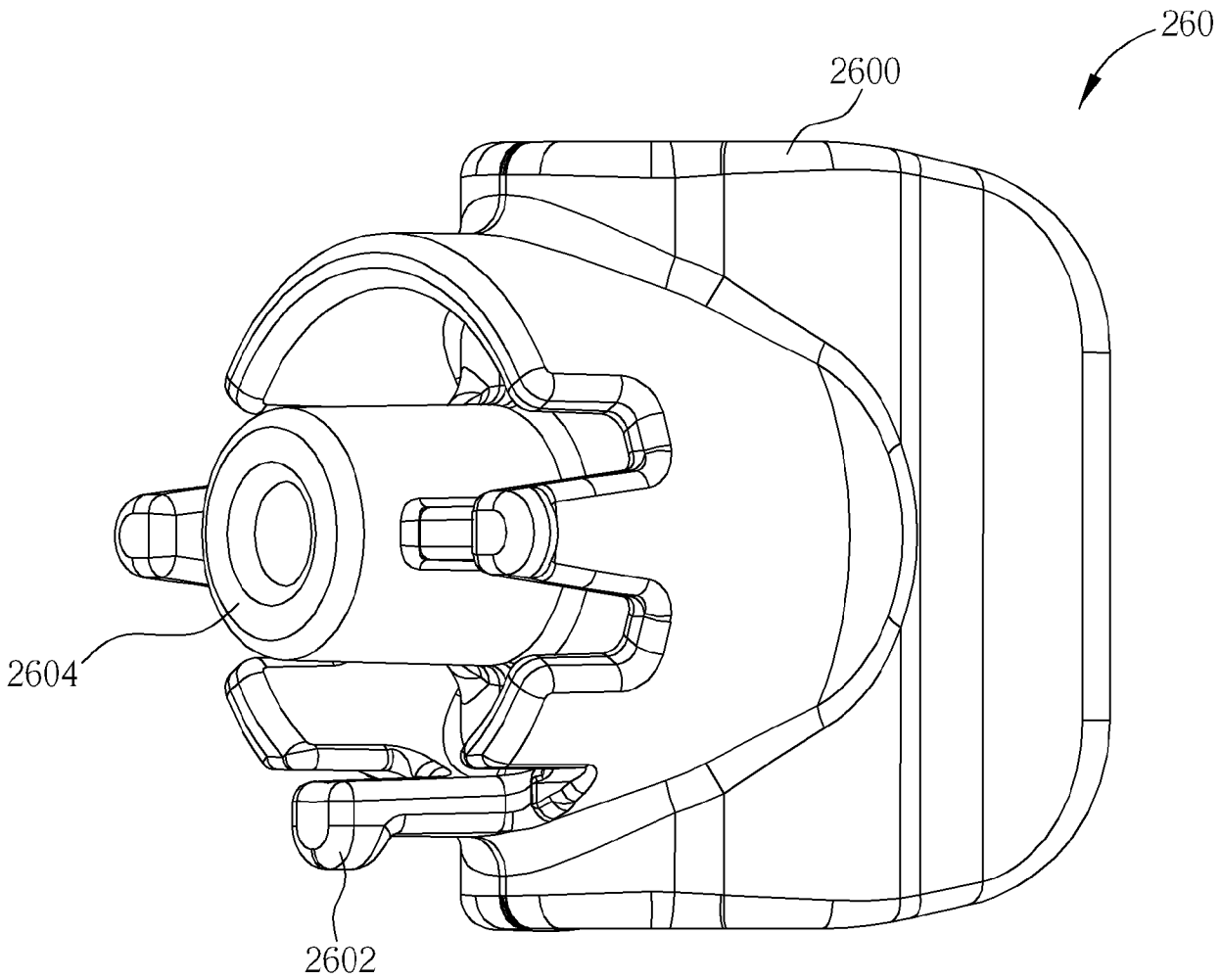
FIG. 7 is a perspective view illustrating a first join member of the join mechanism shown in FIG. 6.
Figure 8:
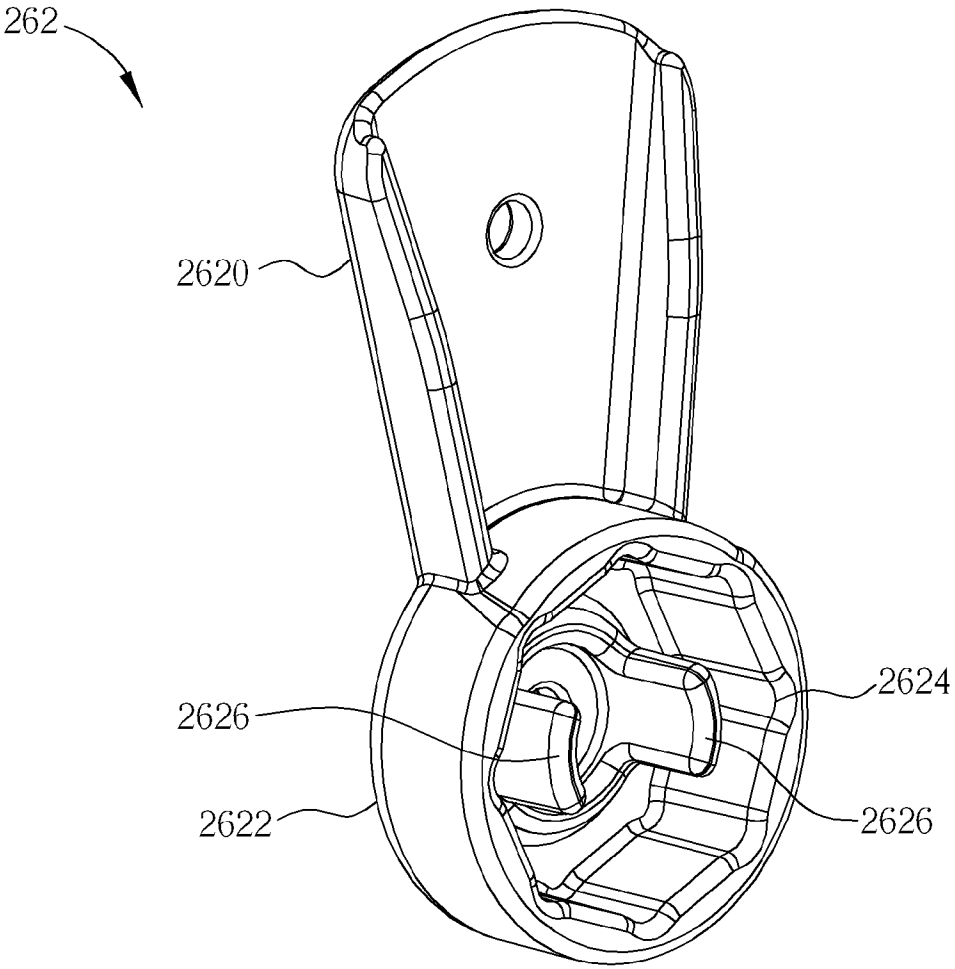
FIG. 8 is a perspective view illustrating a second join member of the join mechanism shown in FIG. 6.

Referring to FIGS. 6 to 8, FIG. 6 is a perspective view illustrating a rotating member 24 rotatably connected to a rear frame 170 of the seat 16 shown in FIGS. 1 and 2 through two join mechanisms 26, FIG. 7 is a perspective view illustrating a first join member 260 of the join mechanism 26 shown in FIG. 6, and FIG. 8 is a perspective view illustrating a second join member 262 of the join mechanism 26 shown in FIG. 6. As shown in FIG. 6, a rotating member 24 is rotatably connected to a rear frame 170 of the seat 16 through two join mechanisms 26. Each of the join mechanisms 26 comprises a first join member 260 and a second join member 262. As shown in FIG. 7, the first join member 260 has a mounting portion 2600, a plurality of resilient portions 2602 and a pillar 2604. The first join member 260 can be removably mounted on the rear frame 170 of the seat 16 through the mounting portion 2600, as shown in FIG. 6. As shown in FIG. 8, the second join member 262 has a connecting portion 2620 and a rotating portion 2622. The second join member 262 can be rotatably mounted on the first join member 260 by inserting the resilient portions 2602 and the pillar 2604 into the rotating portion 2622. Both ends of the rotating member 24 can be connected to the connecting portions 2620 of the second join members 262 respectively, as shown in FIG. 6.

In this embodiment, the rotating portion 2622 has a plurality of indentations 2624 formed on the periphery thereof and two protrusions 2626 protruded from the center thereof. When the resilient portions 2602 and the pillar 2604 are inserted into the rotating portion 2622, the pillar 2604 located between the two protrusions 2626 and the resilient portions 2602 mesh with the indentations 2624 correspondingly. In practical applications, the first join member 260 and the second join member 262 can be pivotally connected to each other by a pivoting member. Accordingly, the rotating member 24 can rotate relative to the rear frame 170 of the seat 16 forward and backward. Furthermore, the resilient portions 2602 and the indentations 2624 provide a function of fine adjustment for the caregiver such that the rotating member 24 can be retained at any one of a number of positions that places the rotating member 24 in the best location for the child in the baby swing 1. This rotational feature also allows the rotating member 24 to be rotated out of the way of the caregiver when accessing the child in the baby swing 1. In practical applications, the rotating member 24 may be a toy bar, a canopy or the like.

Compared to the prior art, since the seat is pivotally mounted on the pivot post of the base, which is mounted on the hanger arms of the supporting device, the seat is able to rotate relative to the base while the second engaging member is located at the releasing position. On the other hand, when the second engaging member moves from the releasing position to the engaging position so as to engage one of the first engaging members of the pivot post, the seat is retained relative to the base. Therefore, the baby swing of the invention can give the caregiver several swing motions to choose from based on the arrangement and the number of the first engaging members. These swing motions may include, but are not limited to, front to back and side to side motions. Furthermore, the open top frame provides the caregiver with unobstructed access to the child in the seat of the baby swing.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A baby swing comprising:

a frame;

a supporting device pivotally connected to the frame, the supporting device having a pivot post, a plurality of first engaging members formed on a periphery of the pivot post, and an arc-shaped guiding groove formed around the pivot post; and a seat having a mounting structure pivotally mounted on the pivot post and a second engaging member disposed in the mounting structure and capable of moving between an engaging position and a releasing position, the mounting structure having a guiding portion slidably disposed in the arc-shaped guiding groove, the arc-shaped guiding groove cooperating with the guiding portion to restrict a rotation range of the seat about the pivot post, the rotation range being smaller than 360 degrees;

wherein when the second engaging member is located at the engaging position, the second engaging member engages one of the first engaging members so that the seat is retained relative to the supporting device; when the second engaging member is located at the releasing position, the second engaging member disengages from the first engaging member so that the seat is allowed to rotate relative to the supporting device.

2. The baby swing of claim 1, wherein a first pivot hole is formed on the mounting structure, a second pivot hole is formed on the pivot post, the seat further comprises a connecting member, and the connecting member passes through the first pivot hole and the second pivot hole so as to pivotally mount the seat on the pivot post.

3. The baby swing of claim 1, wherein the seat further comprises a spring member disposed between the mounting structure and the second engaging member, the spring member bias the second engaging member toward to engage one of the first engaging members.

4. The baby swing of claim 1, wherein the second engaging member has a guiding track, the mounting structure has a guiding rib disposed in the guiding track, and the guiding track cooperates with the guiding rib to guide the second engaging member to move along a movement direction.

5. The baby swing of claim 1, wherein the supporting device comprises two hanger arms pivotally connected to the frame symmetrically.

6. The baby swing of claim 5, wherein the supporting device further comprises a base mounted on the two hanger arms, the pivot post and the arc-shaped guiding groove are formed on the base.

7. The baby swing of claim 1, wherein each of the first engaging members has a taper or arc shape and an engaging end of the second engaging member, which engages the first engaging member, also has a taper or arc shape correspondingly.

8. The baby swing of claim 1, wherein each of the first engaging member is a recess and the second engaging member is a plunger that is biased toward to engage with the recess.

9. The baby swing of claim 5, wherein the supporting device further comprises a base mounted on the two hanger arms, the pivot post is a cylinder formed at the base, the seat comprises a circular pivot seat to couple with the pivot post.

10. A baby swing comprising:

a frame;

a supporting device pivotally connected to the frame, the supporting device having a pivot post an arc-shaped guiding groove;

a seat pivotally mounted on the pivot post of the supporting device, the seat having a guiding portion slidably disposed in the arc-shaped guiding groove, the arc-shaped guiding groove cooperating with the guiding portion to restrict a rotation range of the seat about the pivot post, the rotation range being smaller than 360 degrees; and an engaging device comprising a plurality of first engaging members at one of the supporting device and the seat and a second engaging member at another one of the supporting device and the seat;

wherein the seat is rotated relative to the supporting device between a first position and a second position and will be retained at the first position or the second position when the second engaging member is engaged with one of the first engaging members.

11. The baby swing of claim 10, wherein the first engaging member is a recess and the second engaging member is a plunger that is biased toward to engage with the recess.

12. The baby swing of claim 11, wherein the supporting device has a pivot post and the seat has a pivot seat for pivotally coupling with the pivot post, the recess is formed on a periphery of the pivot post.

13. The baby swing of claim 10, wherein the supporting device has a cylindered pivot post and the seat has a circular pivot seat for coupling with the pivot post, the engaging device is mounted between the pivot post and the pivot seat.

14. The baby swing of claim 13, wherein the plurality of first engaging members is formed at the pivot post.

15. The baby swing of claim 10, wherein each of the first engaging members has a taper or arc shape, and the second engaging member comprises an engaging end that has a taper or arc shape correspondent to the first engaging member, when the seat rotates relative to the supporting device, the second engaging member is pressed toward to a releasing position by the first engaging member.

* * * * *